US010457522B2

(12) United States Patent
Creel, Jr. et al.

(10) Patent No.: US 10,457,522 B2
(45) Date of Patent: Oct. 29, 2019

(54) LIMIT SWITCH SYSTEM INCLUDING FIRST LIMIT DEVICE AND SECOND LIMIT DEVICE

(71) Applicant: Otis Elevator Company, Farmington, CT (US)

(72) Inventors: James O'Neal Creel, Jr., Hemingway, SC (US); John F. Kleine, Jr., Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 641 days.

(21) Appl. No.: 15/199,814

(22) Filed: Jun. 30, 2016

(65) Prior Publication Data

US 2018/0002140 A1 Jan. 4, 2018

(51) Int. Cl.
*B66B 1/34* (2006.01)
*B66B 5/00* (2006.01)

(52) U.S. Cl.
CPC ..... *B66B 5/0087* (2013.01); *B66B 1/3407* (2013.01); *B66B 1/3492* (2013.01); *B66B 5/0056* (2013.01)

(58) Field of Classification Search
CPC ... B66B 5/0087; B66B 1/3407; B66B 1/3492; B66B 5/0056
USPC ..... 187/247, 391, 393, 394
See application file for complete search history.

(56) References Cited

U.S. PATENT DOCUMENTS 6,550,585 B2 4/2003 Schoppa et al.
7,258,202 B1 * 8/2007 Rossignol ..... B66B 5/005 187/351
7,278,517 B2 * 10/2007 Gut ..... B66B 5/005 187/300
7,849,975 B2 12/2010 Ketonen et al.
7,891,467 B2 * 2/2011 Kattainen ..... B66B 5/0056 187/316
8,136,637 B2 * 3/2012 Coquerelle ..... B66B 5/0068 187/302
8,162,108 B2 4/2012 Sirigu et al.
8,602,171 B2 12/2013 Vogl
9,731,936 B2 * 8/2017 Aulanko ..... B66B 5/0068
9,809,420 B2 * 11/2017 Fauconnet ..... B66B 5/18
9,878,877 B2 * 1/2018 Pursiainen ..... B66B 5/0056
10,118,798 B2 * 11/2018 Kattainen ..... B66B 5/0031
2016/0244296 A1 * 8/2016 Ye ..... B66B 17/12
2018/0229666 A1 * 8/2018 Rahm ..... B60R 13/04
2018/0229966 A1 * 8/2018 Karimpanackal Natarajan ..... B66B 5/0068
2018/0327222 A1 * 11/2018 Rocher ..... B66B 5/005

FOREIGN PATENT DOCUMENTS

CN 102344065 A 2/2012
CN 202744128 U 2/2013
CN 203976151 U 12/2014
CN 102381597 B 2/2015
(Continued)

OTHER PUBLICATIONS

European Patent Office, European Search Report for EP17179208, dated Nov. 28, 2017.

*Primary Examiner* — Anthony J Salata
(74) *Attorney, Agent, or Firm* — Cantor Colburn LLP

(57) ABSTRACT

A limit switch system for an elevator. The limit switch system includes a limit device configured to determine a position of the elevator car at a location of the hoistway upon selection of an inspection state.

13 Claims, 2 Drawing Sheets

(56) References Cited

FOREIGN PATENT DOCUMENTS

| | | | |
|---|---|---|---|
| CN | 204150836 | U | 2/2015 |
| CN | 2014150836 | U | 2/2015 |
| CN | 103068710 | B | 7/2015 |
| CN | 107555288 | A | 1/2018 |
| EP | 1475342 | A1 | 11/2004 |
| EP | 2033927 | A1 | 3/2009 |
| EP | 2604565 | A1 | 6/2013 |
| JP | H0346985 | A | 2/1991 |
| JP | H103166188 | A | 7/1991 |
| JP | H107237839 | A | 9/1995 |
| JP | 2001106447 | A | 4/2001 |
| JP | 2002114462 | A | 4/2002 |
| JP | 2006199404 | A | 8/2006 |
| JP | 2007153476 | A | 6/2007 |
| JP | 2011178496 | A | 9/2011 |
| JP | 2013010604 | A | 1/2013 |
| JP | 2014076882 | A | 5/2014 |

* cited by examiner

LIMIT SWITCH SYSTEM INCLUDING FIRST LIMIT DEVICE AND SECOND LIMIT DEVICE

TECHNICAL FIELD OF THE DISCLOSED EMBODIMENTS

The present disclosure is generally related to elevator systems and, more particularly, to a limit switch system for an elevator system.

BACKGROUND OF THE DISCLOSED EMBODIMENTS

Some machines, such as elevator systems, may require occasional or periodic inspection and/or maintenance of various systems and parts. Inspection and/or maintenance of an elevator system may be possible by positioning a mechanic or other person on the top exterior surface or portion of an elevator car. However, some elevator systems or parts, such as an elevator machine, are not immediately accessible for inspection from the top exterior surface of the elevator car due to a final limit control function of an elevator controller. The final limit control function may prevent the elevator car from ascending higher than a particular point in the elevator hoistway.

Therefore, a need exists for a limit switch system that limits upward travel of the elevator car, but allows higher access to one or more portions of an elevator system for inspection and/or maintenance than the normal limit switch alone.

SUMMARY OF THE DISCLOSED EMBODIMENTS

In one embodiment of the present disclosure, an elevator system is provided having a hoistway, an elevator car to travel in the hoistway, and a limit device configured to determine a position of the elevator car at a location of the hoistway upon operating the elevator car in an inspection state.

The limit device may include a first limit device configured to determine a position of the elevator car at a first location of the hoistway in a normal state and a second limit device configured to determine the position of the elevator car at a second location of the hoistway upon operating the elevator car in an inspection state. The first limit device may be activated and the second limit device may be deactivated in a normal state. The second limit device may be activated and the first limit device may be deactivated in the inspection state. The first location may be positioned below the second location. The elevator system may further include a controller connected to the first limit device and the second limit device and an inspection device connected to the controller, the first limit device, and the second limit device and configured to allow selection of the inspection state. The inspection device may include a manually operated switch. The first limit device and the second limit device may be connected to the controller through the inspection device. The elevator system may further include an elevator machine disposed in the hoistway, the second location positioned to provide access to the elevator machine from a top area of the elevator car.

In an embodiment of the present disclosure, a limit switch system for an elevator is provided. The limit switch system includes a limit device configured to determine a position of the elevator car at a location of the hoistway upon selection of an inspection state.

The limit device may include a first limit device configured to detect a position of an elevator car at a first location of a hoistway in a normal state and a second limit device configured to detect a position of the elevator car at a second location of the hoistway upon selection of an inspection state. The first limit device may be activated and the second limit device may be deactivated in a normal state. The second limit device may be activated and the first limit device may be deactivated in the inspection state. The first location may be positioned below the second location. The limit switch system may further include a controller connected to the first limit device and the second limit device and an inspection device connected to the controller, the first limit device, and the second limit device and configured to allow selection of the inspection state. The inspection device may include a manually operated switch. The first limit device and the second limit device may be connected to the controller through the inspection device.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
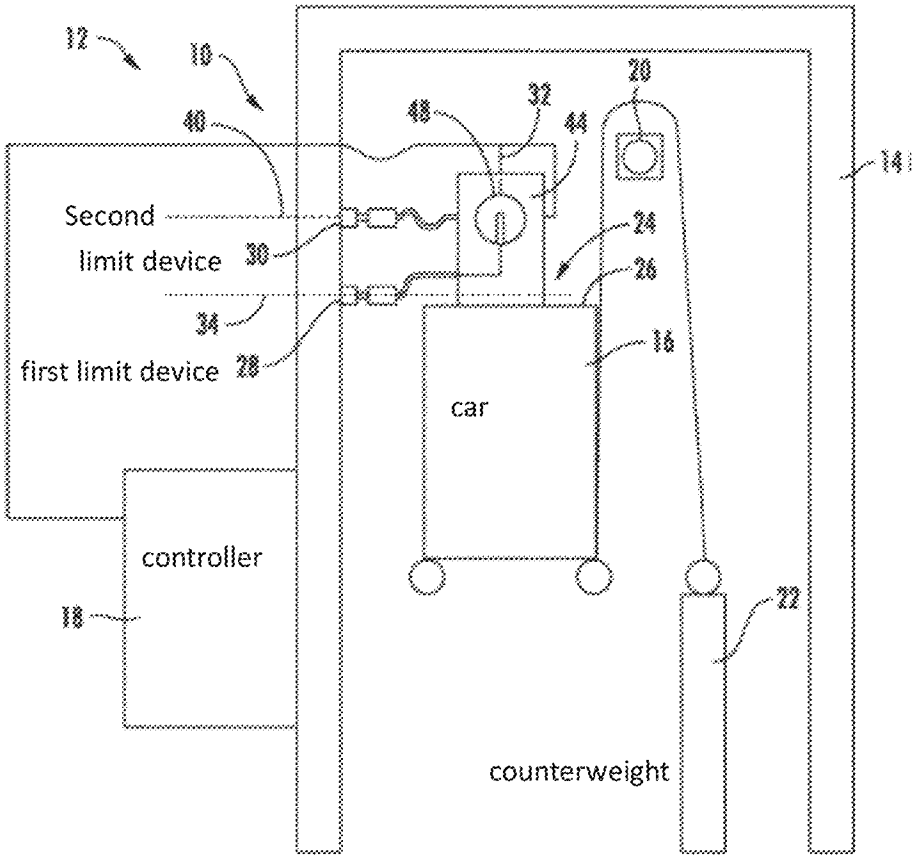
FIG. 1 is a schematic side view of a limit switch system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 depicts a limit switch system 10 for an exemplary elevator system 12 having a hoistway 14 and an elevator car 16. The elevator car 16 is configured to travel in the hoistway 14 in the exemplary embodiment. In the embodiment illustrated in FIG. 1, the elevator car 16 is coupled to a counterweight 22 as understood by one having ordinary skill in the art. An elevator machine 20 is configured to move the elevator car 16 within the hoistway 14. The elevator machine 20 may include a motor, rotating machinery, and/or additional equipment that require periodic maintenance or inspection.

The movement, positioning, or travel of the elevator car 16 within the hoistway 14 is controlled by a controller 18. As conceptually illustrated in FIG. 1, the elevator system 12 of the FIG. 1 embodiment further includes a first limit device 28 and a second limit device 30 operably coupled to an inspection device 44 located on the top surface of the elevator car 16. The inspection device 44 is further coupled to the controller 18. The inspection device 44 includes a manually operated switch 48 in an embodiment, including without limitation one or more toggle switch(es), dial(s), button(s), touchpad(s), lever(s), or any other control, detection, or sensing interface known to a person having ordinary skill in the art.

Figure 2:
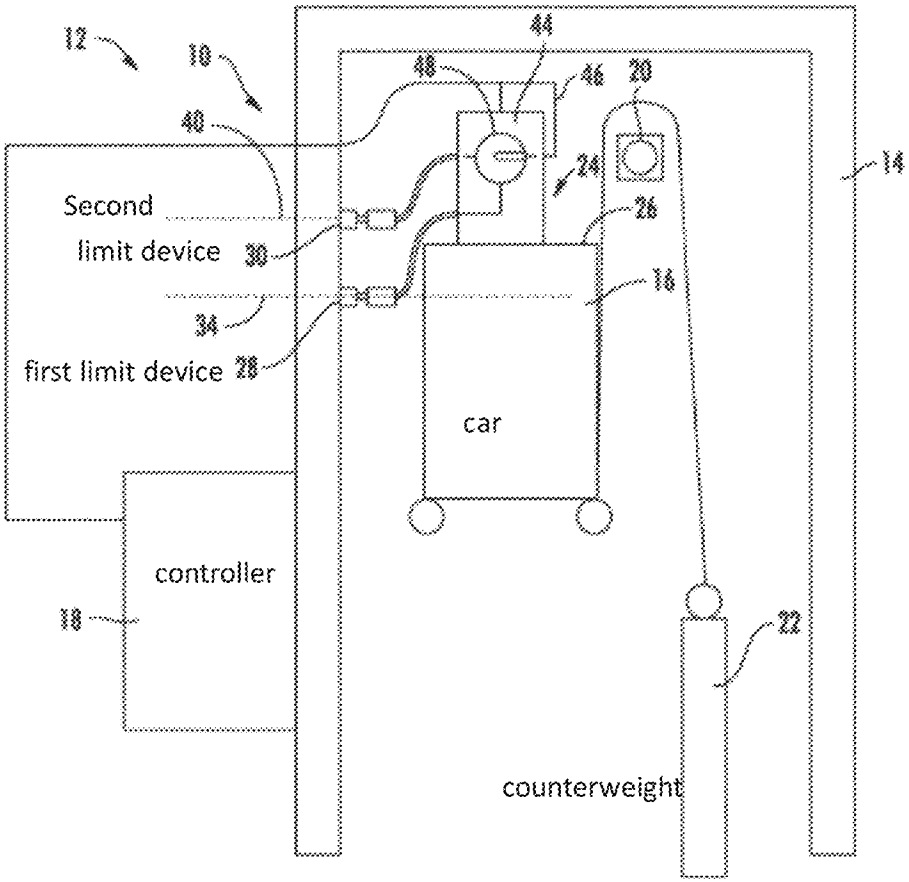
FIG. 2 is a schematic side view of a limit switch system according to an embodiment of the present disclosure.

The inspection device 44 is configured to allow operation of the elevator car 16 in a normal state, as illustrated conceptually in FIG. 1, and an inspection state, as illustrated conceptually in FIG. 2. In the normal state illustrated in FIG. 1, the elevator car 16 is controlled by the elevator controller 18 to travel within the hoistway 14 at a contracted elevator speed to allow passengers to travel within a building. In the inspection state illustrated in FIG. 2, the elevator car 16 is controlled, at a reduced speed, by an elevator mechanic from a top exterior surface 26 of the elevator car 16 using the inspection device 44.

FIG. 1 illustrates a normal state of the limit switch system 10. When the elevator car 16 operates in the normal state and moves or travels to a first location 34 in the hoistway 14, the first limit device 28 senses or detects the presence of the elevator car 16 in the hoistway 14 and sends a first input signal to the controller 18, such as via signal line 32 in one non-limiting example, indicating that the elevator car 16 has reached the first location 34 in the hoistway 14. The controller 18 limits or stops the travel of the elevator car 16 upon receiving the first input signal by removing power to the elevator machine 20 and/or initiating a braking device on the elevator machine 20. In one non-limiting example, the controller 18 initiates a car operation stop circuit to stop the elevator car 16 when the top exterior surface 26 is positioned within a certain level range with respect to the first location 34. One of ordinary skill will recognize the various mechanisms and methods for stopping or limiting travel of the elevator machine 20, and such mechanisms and methods form part of the present disclosure. In one embodiment, the first limit device 28 is a switch, sensor, or detector that is positioned at the first location 34 in the hoistway 14 and is triggered by the elevator car 16. In an additional embodiment, the first limit device 28 is a switch, sensor, or detector that is positioned on the elevator car 16 to determine its relative position. One of ordinary skill in the art will recognize the various devices and methods used for sensing position, movement, and/or velocity, and such devices and methods form part of the present disclosure.

Referring now to the embodiment of FIG. 2, the elevator car 18 is operating in the inspection state. In the inspection state, the elevator car 16 is allowed to move or travel past the first limit device 28 to a second location 40 in the hoistway 14 until the elevator car 16 reaches the second limit device 30. The second limit device 30 senses or detects the presence of the elevator car 16 in the hoistway 14 and sends a second input signal, such as via signal line 46 in one non-limiting example, to the controller 18 indicating that the elevator car 16 has reached the second location 40 in the hoistway 14. In the embodiments of FIGS. 1 and 2, the first location 34 is positioned at a vertical location below the second location 40. The controller 18 limits or stops the travel of the elevator car 16 upon receiving the second input signal such that the elevator car 16 does not travel higher than the second location 40. In one non-limiting example, the controller 18 initiates a car operation stop circuit to stop the elevator car 16 when the top exterior surface 26 is positioned within a certain level range with respect to the second location 40. One of ordinary skill will recognize the various mechanisms and methods for stopping or limiting travel of the elevator machine 20, and such mechanisms and methods form part of the present disclosure. In an embodiment, the first input signal and the second input signal are received by the controller 18 as separate signals. In one embodiment, the second limit device 30 is a switch, sensor, or detector that is positioned at the second location 40 in the hoistway 14 and is triggered by the elevator car 16. In an additional embodiment, the second limit device 30 is a switch, sensor, or detector that is positioned on the elevator car 16 to determine its relative position. One of ordinary skill in the art will recognize the various devices and methods used for sensing position, movement, and/or velocity, and such devices and methods form part of the present disclosure.

In an embodiment, the elevator system 12 includes only a single limit device, which determines a location of the elevator car 16, such as the top exterior surface 26 in one non-limiting example, relative to the first location 34 and/or the second location 40. The single limit device includes a radar sensor, a laser range finder, a magnetometer, an accelerometer, or any one or more similar devices recognized by one having ordinary skill in the art as functioning to determine a location of the elevator car 16.

In the exemplary embodiment of FIG. 2, the second location 40 is positioned to provide access to the elevator machine 20, in the inspection state, from the inspection area 24 of the elevator car 16. The inspection area 24 of the elevator car 16 in one embodiment includes the physical space capable of being occupied by a person standing on the top surface 26 of the elevator car 16. In an embodiment, the inspection area 24 includes a volume of space within the hoistway 14 from 0 feet to 6 feet above the top surface 26 of the elevator car 16. In another embodiment, the inspection area 24 includes a volume of space within the hoistway 14 from 0 feet to 4 feet above the top surface 26 of the elevator car 16. In another embodiment, the inspection area 24 includes a volume of space within the hoistway 14 greater than 6 feet above the top surface 26 of the elevator car 16.

The limit switch system 10 of the embodiments disclosed herein provide the ability for a mechanic or other person to access portions of the elevator system 12 that would be difficult to access from the inspection area 24 of the elevator car 16. During normal elevator operation, the normal state is active and operational to limit the travel and positioning of the elevator car 16 to the first location 34. When maintenance and/or inspection is required, the mechanic or person positions themselves in the inspection area 24 of the elevator car 16 and operates the inspection device 44 to initiate the inspection state. Specifically, in an embodiment, the mechanic will obtain access to the hoistway 14 by entering a landing of the hoistway 14. The mechanic will then access the inspection device 44, such as a top of car inspection (TOCI) box in one non-limiting example. The mechanic will then activate the inspection state, thereby suspending ordinary operation. Upon activation of the inspection state, the elevator car 16 is controllable by the person up to the second location 40. In one non-limiting example, control of the inspection device 44 includes access to up, down, and common control buttons of the inspection device 44. The travel and positioning of the elevator car 16 in the inspection state may not exceed the second location 40.

Upon completion of the inspection and/or maintenance, the person operates the inspection device 44 to return the limit switch system 10 to the normal state, and the elevator car 16 automatically descends or is controllable by the person to descend to the first location 34 or a location lower than the first location 34.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system comprising:

a hoistway;

an elevator car to travel in the hoistway; and a limit device configured to determine a position of the elevator car at a location of the hoistway upon operating the elevator car in an inspection state;

wherein the limit device includes a first limit device configured to determine a position of the elevator car at a first location of the hoistway in a normal state and a second limit device configured to determine the position of the elevator car at a second location of the hoistway upon operating the elevator car in an inspection state;

wherein the first location and the second location are located at a top of the hoistway, the first location positioned at a vertical location below the second location.

2. The elevator system of claim 1, wherein the first limit device is activated and the second limit device is deactivated in a normal state.

3. The elevator system of claim 1, wherein the second limit device is activated and the first limit device is deactivated in the inspection state.

4. The elevator system of claim 1, further comprising:

a controller connected to the first limit device and the second limit device; and an inspection device connected to the controller, the first limit device, and the second limit device and configured to allow selection of the inspection state.

5. The elevator system of claim 4, wherein the inspection device includes a manually operated switch.

6. The elevator system of claim 4, wherein the first limit device and the second limit device are connected to the controller through the inspection device.

7. The elevator system of claim 1, further comprising an elevator machine disposed in the hoistway, the second location positioned to provide access to the elevator machine from a top area of the elevator car.

8. A limit switch system for an elevator, the limit switch system comprising:

a limit device configured to determine a position of the elevator car at a location of the hoistway upon selection of an inspection state;

wherein the limit device includes a first limit device configured to detect a position of an elevator car at a first location of a hoistway in a normal state and a second limit device configured to detect a position of the elevator car at a second location of the hoistway upon selection of an inspection state;

wherein the first location and the second location are located at a top of the hoistway, the first location positioned at a vertical location below the second location.

9. The limit switch system of claim 8, wherein the first limit device is activated and the second limit device is deactivated in a normal state.

10. The limit switch system of claim 8, wherein the second limit device is activated and the first limit device is deactivated in the inspection state.

11. The limit switch system of claim 8, further comprising:

a controller connected to the first limit device and the second limit device; and an inspection device connected to the controller, the first limit device, and the second limit device and configured to allow selection of the inspection state.

12. The limit switch system of claim 11, wherein the inspection device includes a manually operated switch.

13. The limit switch system of claim 11, wherein the first limit device and the second limit device are connected to the controller through the inspection device.

* * * * *